United States Patent [19]

Williamson

[11] Patent Number: 4,759,334

[45] Date of Patent: Jul. 26, 1988

[54] METHOD AND DEVICE FOR FEEDING FUEL IN A FUEL SYSTEM

[76] Inventor: Edwin Williamson, 6800 West Old Shakopee Rd., Bloomington, Minn. 55437

[21] Appl. No.: 86,799

[22] Filed: Aug. 19, 1987

[51] Int. Cl.[4] ..... F02M 39/00; F04F 10/00

[52] U.S. Cl. ..... 123/510; 137/212; 137/145; 220/85 R; 220/86 R; 215/307; 215/358

[58] Field of Search ..... 123/510, 516, 511, 533; 220/85 R, 86 R, 85 UR, 85 SP; 137/145, 212; 215/261, 271, 301, 302, 307, 319, 348, 358

[56] References Cited

U.S. PATENT DOCUMENTS

| | | | |
|---|---|---|---|
| 140,815 | 7/1873 | de Guinon . | |
| 646,018 | 3/1900 | Cook | 215/307 |
| 1,043,488 | 11/1912 | Waugh | 137/145 |
| 1,095,763 | 5/1914 | Winton | 123/510 |
| 1,328,866 | 1/1920 | Yeatter | 137/212 |
| 1,565,461 | 12/1925 | Huntley | 137/212 |
| 2,802,587 | 8/1957 | Parvin | 215/307 |
| 3,003,659 | 10/1961 | Miller | 220/85 R |
| 3,211,195 | 10/1965 | Porter | 220/85 SP |
| 3,490,483 | 1/1970 | Nicko | 137/212 |
| 3,803,858 | 4/1974 | Simon | 62/52 |
| 4,310,013 | 1/1982 | McClaskey | 137/145 |
| 4,321,949 | 3/1982 | Mercier | 220/85 R |
| 4,355,111 | 10/1982 | Shimizu | 215/307 |
| 4,529,105 | 7/1985 | Kewins | 137/212 |
| 4,590,796 | 5/1986 | Baatz | 73/113 |
| 4,690,293 | 9/1987 | Uranishi | 220/86 R |

FOREIGN PATENT DOCUMENTS

| | | | |
|---|---|---|---|
| 244186 | 1/1963 | Australia | 220/85 SP |
| 1276384 | 10/1961 | France | 215/358 |
| 600956 | 12/1959 | Italy | 215/358 |

*Primary Examiner*—Carl Stuart Miller

*Attorney, Agent, or Firm*—Peterson, Wicks, Nemer, & Kamrath

[57] ABSTRACT

A method for feeding fuel in a fuel system is disclosed in its most preferred form utilizing a device including a valve stem which is reciprocally received through a bore in a foam rubber ball. The valve stem includes a plate which may be pulled against the ball to seal the valve stem in the bore. The ball is of solid cross section and has a size for overfitting and abutting with the fill opening of a fuel tank. The ball is deformable to conform to the perimeter of the fill opening for sealingly engaging the perimeter of the fill opening and has a firmness for transmitting a force applied to the ball in the direction of the fill opening into a sealing force applied by the ball to the fill opening to balance opposing forces created by the introduction of air pressure into the fuel tank through the valve stem and for allowing an excessive air pressure to escape from the fill opening around the ball. In an alternate embodiment, the device further includes a slide for transmitting the non-uniform force applied by the user's hand to the ball in a uniform manner.

19 Claims, 1 Drawing Sheet

METHOD AND DEVICE FOR FEEDING FUEL IN A FUEL SYSTEM

BACKGROUND

The present invention relates generally to a method and device for feeding liquid fuel to engines, particularly to a method and device for feeding fuel to a diesel engine and specifically for feeding fuel to a large diesel engine.

Large diesel engines have many uses including stationary applications, marine applications, and earth-moving equipment applications. The major investment made by the user of a diesel engine requires that the engine be operational when needed. This is necessary so that the engine may deliver the intended benefits and thereby provide a return on the investment of the user. This operational readiness is further improved when service time or downtime is kept to a minimum. Road construction activities make great use of construction equipment powered with large diesel engines. Thus, the public interest in timely completion of road construction projects is served by minimizing the downtime of the earth-moving equipment.

The fuel system of a large diesel engine includes multiple stages of fuel filtering in order to provide sufficiently clean fuel to the engine fuel injectors. The extensive fuel filtering needs make it necessary to service the fuel filters frequently. Fuel filter servicing generally includes replacement of the microscreen filtering element. Other events, for example, an engine running out of fuel, also require fuel system servicing. The size of the equipment, its limited mobility and the need to minimize equipment downtime make field servicing as opposed to shop servicing a necessary approach. Servicing tools, techniques and procedures must therefore be designed for variable field use conditions such as wide temperature ranges, dusty environments and the like.

In the past after servicing of the fuel system, the fuel pump must be operated for an extended time. This is necessary because the pump must draw liquid fuel from the fuel tank through the multiple microscreen fuel filter stages and deliver the fuel to the engine. The resistance to flow of the small fuel passages in the microscreen filters causes the extended pumping time. The pumping time is further extended when low ambient temperatures increase the viscosity of the fuel.

The extended pumping time results in excessive downtime. In addition, the extended pumping time causes an excessive drain on the battery that powers the fuel pump and excessive wear on the fuel pump components which results in a shortened service life for the battery and the fuel pump.

Thus a need exists in the field of servicing fuel systems on large diesel engines for a fuel feeding device and method that greatly reduces the engine downtime. Further a need exists for a fuel feeding device and method that is simple to use under varying field servicing conditions, is low cost, and is inherently safe for use by the diesel engine service person.

SUMMARY

The present invention solves these needs and problems in fuel system servicing by providing a device for feeding fuel in a fuel system for a liquid fuel engine. Specifically, air pressure is introduced into the fuel tank through a ball overfitting and abutting with the fill opening. The ball has a solid cross section and is deformable to conform to the perimeter of the fill opening for sealingly engaging the perimeter of the fill opening and has a firmness for transmitting a force applied to the ball in the direction of the fill opening into a sealing force applied by the ball to the fill opening to balance opposing forces created by the introduction of air pressure into the fuel tank and for increasing the air pressure in the fuel tank acting on the fuel to increase the rate of fuel flow from the fuel tank into the fuel line for assisting the fuel pump in moving the fuel from the fuel tank through the fuel lines and through the microscreen filters to the engine fuel injectors while allowing an excessive air pressure to escape from the fill opening around the ball.

In another aspect of the present invention, air pressure is introduced into the fuel tank by a valve stem slideably disposed in a bore of the ball. A plate is connected adjacent to the second end of the valve stem for being pulled against and sealingly engaging with the ball adjacent to the bore.

It is thus an object of the present invention to provide a novel method for feeding fuel in a fuel system.

It is thus an object of the present invention to provide a novel device for feeding fuel in a fuel system.

It is further an object of the present invention to provide such a novel method and device which is inherently safe.

It is further an object of the present invention to provide such a novel method and device which is simple and easy to utilize.

It is further an object of the present invention to provide such a novel method and device which is economical.

It is further an object of the present invention to provide such a novel method and device which reduces strain and wear on the fuel system and the engine components.

It is further an object of the present invention to provide such a novel method and device which reduces fuel system servicing time.

It is further an object of the present invention to provide such a novel method and device which reduces downtime.

It is further an object of the present invention to provide such a novel device which is not prone to breakage and wear.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
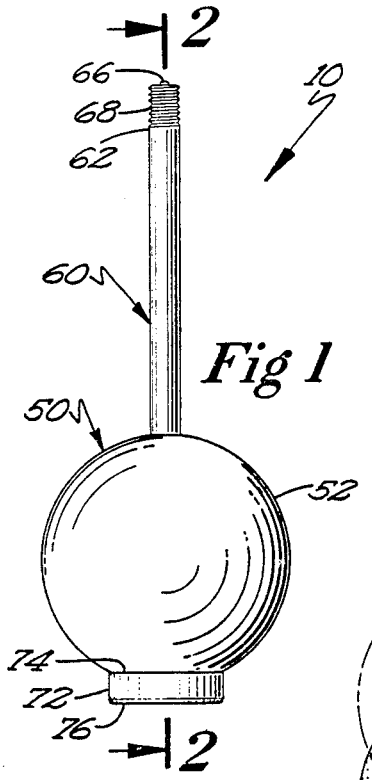
FIG. 1 shows a front, plan view of a device for feeding liquid fuel according to the teachings of the present invention.
Figure 2:
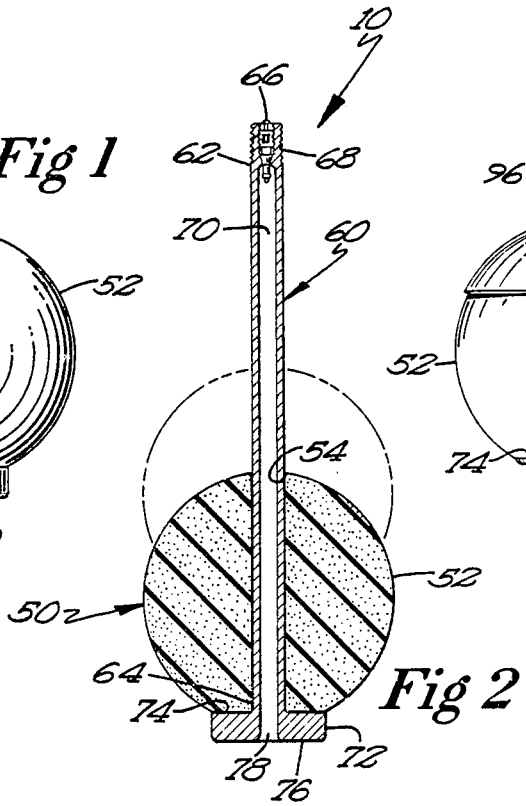
FIG. 2 shows a cross-sectional view of the liquid fuel feeding device of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inner", "outer", and similar terms are used herein, it should be understood that these terms have reference only to the structure shown in the drawings as it would appear to a person viewing the drawings and are utilized only to facilitate describing the invention.

DESCRIPTION

Fuel feeding devices according to the teachings of the present invention are shown in the figures and generally designated 10. Device 10 in its preferred forms is shown for fuel feeding use with a liquid fuel engine such as a large diesel engine. A diesel engine fuel system 11 generally includes a fuel tank 12, a first stage filter 14, a second stage filter 16, a third stage filter 18, fuel pump 20, engine fuel injectors 22 and fuel lines 24, 26, 28, 30 and 32. Fuel tank 12 includes liquid fuel 34, an air space 36, and a fill opening 38 having fill opening perimeter 40. Pump 20 draws liquid fuel 34 out of fuel tank 12 through fuel line 24, primary filter 14, fuel line 26, secondary filter 16, fuel line 28, third stage filter 18, and fuel line 30. From pump 20, fuel 34 flows through fuel line 32 to engine fuel injectors 22 which supply the fuel to run the engine.

Device 10 according to the teachings of the present invention includes ball 50 shown in its most preferred form as spherical in shape. Ball 50 has a solid cross section of uniform consistency, and in the preferred form, formed of foam rubber, with its characteristics being set forth in connection with the use of device 10. The size and diameter of ball 50 is larger than the size and diameter of perimeter 40 of fill opening 38 to allow ball 50 to have an overfitting and abutting relation with perimeter 40 of fill opening 38 of differing sizes, shapes, and constructions.

Ball 50 according to the teachings of the present invention includes a bore 54 extending through ball 50 and in the most preferred form, bore 54 lies along a diameter of ball 50.

Device 10 according to the teachings of the present invention further includes a valve stem 60 having a first end 62 and a second end 64. First end 62 includes a compressed air connector 68 and a valve 66. Valve 66 allows admittance of air pressure greater than atmospheric to air passageway 70 when a source 71 of air pressure greater than the air pressure within passageway 70 is applied to connector 68. When there is no connection made to compressed air connector 68, valve 66 prevents the exit of air pressure from passageway 70.

In its preferred form, second end 64 of valve stem 60 includes plate 72 attached generally perpendicularly to valve stem 60. Plate 72 has a first, upper surface 74, a second, lower surface 76, and a hole 78 in communication with passageway 70. The length of valve stem 60 between ends 62 and 64 is greater than the diameter of ball 50 and specifically the length of bore 54. In its most preferred form, bore 54 has a shape and size for slideably receiving valve stem 60 and has a shape and size smaller than upper surface 74 of plate 72 to allow plate 72 to abut and sealingly engage ball 50 adjacent to bore 54.

Now that the basic construction of fuel feeding device 10 according to the teachings of the present invention has been disclosed, the method of use, subtle features, and further distinctions of fuel feeding device 10 according to the teachings of the present invention can be set forth and appreciated. Device 10 may be used to feed fuel to a liquid fuel engine such as a diesel engine. Device 10 may be typically used following the servicing of the fuel system of the diesel engine. The servicing of the fuel system will often include the replacement of microscreen filter elements which have become clogged with material filtered from the liquid fuel. Servicing of the fuel system may be required for other reasons, for example the engine may have run out of fuel.

To utilize fuel feeding device 10, first end 62 of valve stem 60 may be inserted into and through bore 54 of ball 50 until plate 74 abuts with ball 50. Ball 50 may then be grasped with first end 62 of valve stem 60 extending between two fingers of the hand. First end 62 may then be pulled by the two fingers to cause upper surface 74 of plate 72 to abut and sealingly engage ball 50 adjacent bore 54. After removal of the fuel opening cover from fuel opening 38 of fuel tank 12, ball 50 may then be placed onto fill opening 38 with second end 64 of valve stem 60 within the portion of ball 50 engaging with fill opening 38 and first end 62 of valve stem 60 outside the portion of ball 50 engaging with fill opening 38. Ball 50 may be pushed onto fill opening 38 to cause the surface portion of ball 50 abutting with perimeter 40 of fill opening 38 to deform to conform to perimeter 40 of fill opening 38 while continuing to pull valve stem 60 so that upper surface 74 of plate 72 abuts and sealingly engages with ball 50 adjacent bore 54. Air pressure greater than atmospheric may then be introduced into fuel tank 12 through valve stem 60 such as by source 71 connected to connector 68 either before or during pushing ball 50 against fill opening 38. It can then be appreciated by those experienced in the art that the operation of device 10 as described will result in an effective air pressure seal at fill opening 38 which will allow air space 36 of fuel tank 12 to be pressurized to a pressure greater than atmospheric. The pressure sealing function of device 10 includes the separate air pressure seals formed by ball 50 conforming to perimeter 40 of fill opening 38 and upper surface 74 of plate 72 abutting and sealingly engaging ball 50 adjacent bore 54. Further, it can be appreciated that an excessive build up of air pressure will be automatically released from fuel tank 12 by the air pressure pushing against ball 50 against the force of the user pushing on ball 50 in the opposite direction allowing air pressure to escape from fill opening 38. When the air pressure decreases in fuel tank 12 to less than the force of the user pushing on ball 50, ball 50 automatically seals with fill opening 38 preventing further escape of air pressure from fuel tank 12 and again allowing the increase of air pressure in fuel tank 12. Thus, it is not necessary to control source 71 of air pressure as air pressure may be continually supplied without concern.

It may be appreciated that the force applied by the hand of the service person forcing ball 50 onto perimeter 40 of fill opening 38 accomplishes several functions. First, the force applied balances an opposing force created by the pressure within fuel tank 12 acting on the portion of ball 50 within perimeter 40 of fill opening 38. Specifically, pressure acts on both ball 50 and on lower surface 76 of plate 72. The pressure acting against lower surface 76 of plate 72 is transferred to ball 50 by upper surface 74 of plate 72. It can be appreciated that the force that needs to be applied to ball 50 by the hand of the service person will increase as pressure in air space 36 of tank 12 increases.

Further, the force applied by the hand of the service person is transmitted by ball 50 to provide a sealing force between ball 50 and perimeter 40 of fill opening 38. It may be appreciated that the amount of force that must be applied to ball 50 by the hand of the service person to provide a sealing force will increase as pressure in tank 12 increases. The ability of the seal formed by ball 50 with perimeter 40 to maintain pressure will depend on the surface area contact of ball 50 with perimeter 40 and the force exerted by ball 50 on perimeter 40. For example, a much smaller area of surface contact and therefore a much smaller sealing force will be required to maintain 1 psi pressure than would be required to maintain 30 psi pressure within tank 12.

It can then be appreciated that ball 50 includes several characteristics in its most preferred form to allow each of the numerous advantages according to the teachings of the present invention. The first such characteristic is the general prevention of air passage therethrough. Specifically, if air could generally pass or permeate through ball 50, pressure introduced through valve stem 60 cannot be maintained within fuel tank 12 for fuel feeding as in the present invention.

Additionally, ball 50 according to the teachings of the present invention must have the firmness necessary to provide a stable means for transmitting the forces applied to ball 50 while preventing ball 50 from being pushed into and through fill opening 38 to balance the opposing force created by the pressure within the fuel tank 12. The firmness of ball 50 according to the teachings of the present invention is generally obtained by two features, namely its solid cross section and the material. It can be appreciated that a hollow construction would have a tendency to collapse when external pressure is placed thereon such as is necessary to balance the opposing force created by the pressure within the fuel tank 12. Collapse of the ball could result in the ball having a lesser size than fill opening 38 such that it would pass therein. Further, sealing of the ball with fill opening 38 may be impaired such that sufficient pressure within fuel tank 12 cannot be maintained for fuel feeding as in the present invention. Further, it can be appreciated that the material such as foam rubber must have sufficient structural integrity and rigidness to prevent the ball from being deformed and/or divided or broken to pass through fill opening 38 as would occur if silly putty were placed on fill opening 38.

Another such characteristic is deformability necessary to allow ball 50 to sealingly engage with fill opening 38. As an example, if a bowling ball were placed on fill opening 38, an effective seal would not be created such that air would readily escape from fill opening 38 around the bowling ball. Thus, sufficient pressure within fuel tank 12 cannot be maintained for fuel feeding as in the present invention. Foam rubber from which ball 50 is formed in the present invention allows ball 50 to deform to conform to the shape and contour of perimeter 40 of fill opening 38 to seal therewith but has sufficient firmness as previously discussed to prevent ball 50 from establishing a seal preventing release of excessive pressure from within fuel tank 12.

In the most preferred form, ball 50 has a resilient characteristic such that ball 50 will return to its original shape after pressure thereon is released and device 10 is removed from fill opening 38. Therefore, ball 50 does not keep the shape and contour of perimeter 40 of fill opening 38 allowing its reuse on fill openings 38 of differing sizes, shapes, and constructions. Further, the life of ball 50 and thus device 10 is extended because it is not necessary to deform ball 50 to conform between differing fill openings 38 but rather from its free state.

Figure 3:
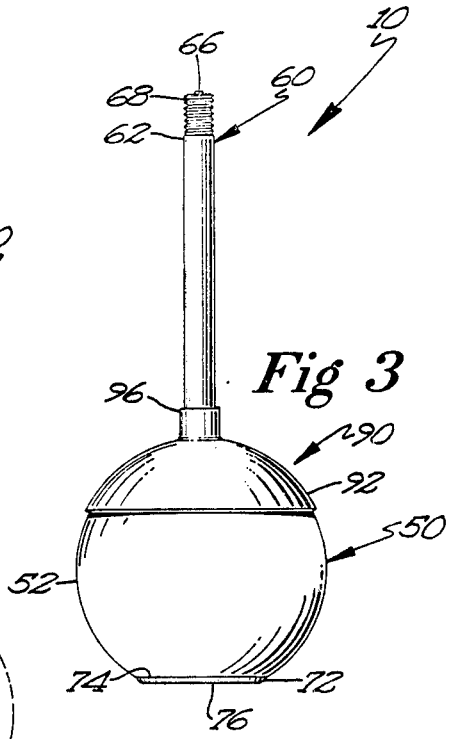
FIG. 3 shows a front, plan view of an alternate embodiment of a device for feeding liquid fuel according to the teachings of the present invention.
Figure 4:
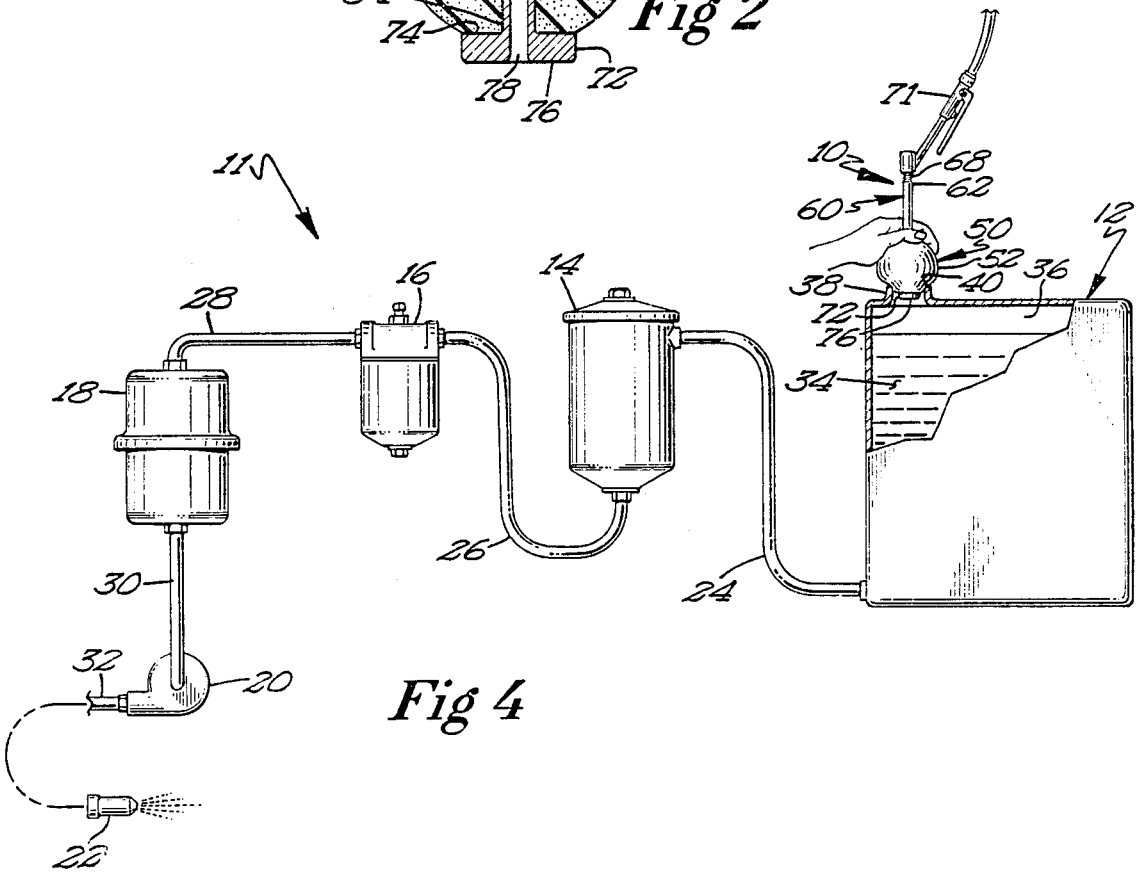
FIG. 4 shows a front, plan view of the liquid fuel feeding device of FIG. 1 and of a fuel system illustrating the method of feeding liquid fuel according to the teachings of the present invention.

An alternate embodiment of device 10 according to the teachings of the present invention is shown in FIG. 3 including a slide 90. In the preferred form, slide 90 includes a hollow semispherical shell 92 having a size and shape complementary to ball 50. Slide 90 further includes a tube 96 mounted to semispherical shell 92 aligned with a hole formed in shell 92.

In operation, slide 90 is slideably mounted on valve stem 60 with valve stem 60 extending through the hole of shell 92 and through tube 96. The inner surface of shell 92 is then in contact with the surface of ball 50. The service person may then apply a force to the outer surface of slide 90 in the direction of fill opening 38. Slide 90 then transmits the nonuniform force applied by the service person's hand to the outer surface of slide 90 into a uniform force applied by the inner surface of slide 90 to ball 50.

Now that the construction and operation of device 10 have been set forth, many advantages can be further set forth and appreciated. Device 10 provides a simple, easy to use, yet inherently safe method of fuel feeding. Applying air pressure to a closed fuel tank containing fuel requires that certain precautions be observed to limit the pressure within the fuel tank to a value known to be safe. Otherwise there is a risk that too high an air pressure will develop within the tank which may rupture the tank and cause fuel to be thrown on the service person. Safety relief valves, indicating pressure gauges and the like may be connected to help assure that only safe pressures are applied within fuel tanks. This requires the added expense of valves and gauges and their installation. Further, such valves, gauges, and the like are prone to breakage and wear which reduce their safety and efficiencies. They also make the fuel feeding process more complex and would require that the service person understand the use of gauges, the amount of pressure that can be safely applied and that only safe procedures be used. The varying fuel conditions of weather, temperature, darkness, etc. under which fuel feeding will be required and used all argue for an inherently safe fuel feeding method.

The present invention provides a simple, easy to use, and inherently safe fuel feeding technique. It can be appreciated that if pressure in fuel tank 12 continues to increase, it will reach a level that will automatically force ball 50 and the service person's hand away from fuel opening 38 enough to cause the pressure to be vented. For standard sizes of fuel openings, ball 50 will be forced away from fill opening 38 before air pressure becomes excessive or in any way presents a safety risk and in the most preferred form exceeds approximately 30 psi.

Further, the use of device 10 is extremely simple to understand. No gauges or knowledge of safe air pressures is needed by the service person. This simplicity of operation is an especially significant advantage because of the variable field conditions under which device 10 will be used.

According to the teachings of the present invention, device 10 may be manufactured from simple, readily available and low cost components. Further, no additional field servicing tools are needed to obtain the benefits of fuel feeding device 10 other than a source of air pressure which will likely be typically available for other servicing uses. The present invention does not include parts that will be subject to wear and may therefore be expected to have a long service life.

Device 10 according to the teachings of the present invention can be used to advantageously reduce the down time of large diesel engines following the servicing of the engine fuel system. Very large reductions in engine down time may be achieved. For example, restoring liquid fuel flow to a large diesel engine after fuel system servicing without the fuel feeding device, i.e., by operation of the fuel pump only may require 1 to 1½ hours. Utilizing fuel feeding device 10 may reduce this to a 15 minute period. In addition to increasing the productivity of the engine through reduced downtime device 10 also reduces strain and wear on components such as the battery and fuel pump since these components operate for a much shorter time when device 10 is used after fuel system servicing.

It can then be appreciated that device 10 according to the teachings of the present invention cannot harm the fuel system or any other components of the engine and is safe for the user. It can also be appreciated that device 10 according to the teachings of the present invention reduces servicing time to reduce equipment downtime and to reduce strain and wear on the fuel system and the engine.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for feeding fuel in a fuel system for a liquid fuel engine, with the fuel system having a fuel tank, fuel lines, multiple microscreen fuel filters, a fuel pump, and engine fuel injectors, with the fuel tank having a fill opening having a perimeter, comprising, in combination: a ball having a size for overfitting and abutting with the perimeter of the fill opening of differing sizes, shapes, and constructions; and means for introducing air pressure greater than atmospheric through the ball and through the fill opening and into the fuel tank, with the ball having a solid cross section and being generally impermeable to air passage, with the ball being deformable to conform to the perimeter of the fill opening for sealingly engaging the perimeter of the fill opening and having a firmness for transmitting a force applied to the ball in the direction of the fill opening into a sealing force applied by the ball to the fill opening to balance opposing forces created by the introduction of air pressure into the fuel tank and for increasing the air pressure in the fuel tank acting on the fuel to increase the rate of fuel flow from the fuel tank into the fuel line for assisting the fuel pump in moving the fuel from the fuel tank through the fuel lines and through the microscreen filters to the engine fuel injectors while allowing an excessive air pressure to escape from the fill opening around the ball.

2. The device of claim 1 wherein the ball sealingly engages the perimeter of the fill opening in a first portion; and wherein the means for introducing air pressure greater than atmospheric comprises, in combination: a bore formed in the ball extending from a location inside the first portion to a location outside the first portion of the ball; a valve stem extending in the bore having a first end which includes means for connecting to a source of air pressure and a second end, with the first end of the valve stem located outside the first portion of the ball; and means for sealing the valve stem with the bore of the ball.

3. The device of claim 2 wherein the valve stem is slideably disposed in the bore of the ball; and wherein the means for sealing the valve stem with the bore comprises, in combination: a plate connected adjacent to the second end of the valve stem for being pulled against and sealingly engaging with the ball adjacent to the bore.

4. The device of claim 2 wherein the ball has a spherical cross section.

5. The device of claim 4 further comprising, in combination: means for transforming a non-uniform force into a uniform force applied perpendicularly to the ball, with the ball transmitting the uniform force to the sealing engagement of the ball with the perimeter of the fill opening to effect a seal therebetween.

6. The device of claim 5 wherein the transforming means comprises, in combination: a slide having a shape complementary to and for removable engagement and abutment with the ball.

7. The device of claim 6 wherein the slide comprises, in combination: a shell having an outer surface; and a tube for slideable receipt on the valve stem, with the tube extending from the outer surface of the shell.

8. The device of claim 7 wherein the shell has a semispherical shape.

9. The device of claim 1 wherein the ball has resiliency to return to its original shape after the force applied to the ball is removed.

10. The device of claim 9 wherein the ball is formed of foam rubber.

11. The device of claim 10 wherein the ball has a uniform consistency for ease of manufacture.

12. The device of claim 1 further comprising, in combination: means for transforming a non-uniform force into a uniform force applied perpendicularly to the ball, with the ball transmitting the uniform force to the sealing engagement of the ball with the perimeter of the fill opening to effect a seal therebetween.

13. The device of claim 12 wherein the transforming means comprises, in combination: a slide having a shape complementary to and for removable engagement and abutment with the ball.

14. The device of claim 13 wherein the slide comprises, in combination: a shell having an outer surface; and a tube for slideable receipt on the valve stem, with the tube extending from the outer surface of the shell.

15. The device of claim 1 wherein the ball has a spherical cross section.

16. Method for feeding fuel in a fuel system for a liquid fuel engine, with the fuel system having a fuel tank, fuel lines, multiple microscreen fuel filters, a fuel pump and engine fuel injectors, with the fuel tank having a fill opening having a perimeter, with the method comprising the steps of:

(a) providing a ball having a size that will overfit the perimeter of the fill opening, with the ball having a bore extending through the ball;

(b) providing a valve stem having a first end and a second end, with the valve stem including a plate adjacent to the second end extending generally perpendicularly to the valve stem;

(c) inserting the first end of the valve stem into and through the bore of the ball;

(d) pushing the ball onto the fill opening for sealing engagement with the fill opening, with the second end of the valve stem positioned within the fuel opening;

(e) simultaneously with pushing the ball pulling the valve stem to cause the plate of the valve stem to abut with the ball for sealing the valve stem in the bore of the ball;

(f) applying air pressure greater than atmospheric to the first end of the valve stem for increasing the air pressure within the fuel tank for assisting the fuel pump in drawing the fuel from the fuel tank through the fuel lines and through the microscreen filters to the engine fuel injectors; and (g) operating the fuel pump for drawing fuel from the fuel tank through the fuel lines and through the multiscreen filters until the fuel reaches the engine fuel injectors.

17. The method of claim 16 wherein the step of providing a ball comprises the step of providing a ball having a solid cross section and being deformable to conform to the perimeter of the fill opening for sealingly engaging the perimeter of the fill opening and having a firmness for transmitting a force applied to the ball in the direction of the fill opening into a sealing force applied by the ball to the fill opening to balance opposing forces created by the introduction of air pressure into the fuel tank through the valve stem and for increasing the air pressure in the fuel tank acting on the fuel to increase the rate of fuel flow from the fuel tank into the fuel line for assisting the fuel pump in moving the fuel from the fuel tank through the fuel lines and through the microscreen filters to the engine fuel injectors while allowing an excessive air pressure to escape from the fill opening around the ball.

18. The method of claim 16 further comprising the steps of:

(a) providing a slide having a shape complementary to and for removeable engagement and abutment with the ball, with the slide being adapted for reciprocal receipt on the valve stem; and (b) placing the slide on the valve stem after the valve stem is inserted into and through the bore of the ball; and wherein the step of pushing the ball onto the fill opening comprises the step of pushing on the slide, with the slide transmitting the force to the ball.

19. The method of claim 16 wherein the step of providing a ball comprises the step of providing a ball having a spherical shape.

* * * * *